US010337137B2

(12) United States Patent
Jung et al.

(10) Patent No.: US 10,337,137 B2
(45) Date of Patent: Jul. 2, 2019

(54) CLOTHES TREATING APPARATUS

(71) Applicant: LG ELECTRONICS INC., Seoul (KR)

(72) Inventors: Joosik Jung, Seoul (KR); Jaehyung Kim, Seoul (KR); Hyungha Kang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 384 days.

(21) Appl. No.: 15/227,275

(22) Filed: Aug. 3, 2016

(65) Prior Publication Data

US 2017/0037562 A1 Feb. 9, 2017

(30) Foreign Application Priority Data

Aug. 4, 2015 (KR) ..... 10-2015-0110228

(51) Int. Cl.

| | |
|---|---|
| ***F26B 21/06*** | (2006.01) |
| ***D06F 58/24*** | (2006.01) |
| ***D06F 58/20*** | (2006.01) |
| ***D06F 58/02*** | (2006.01) |
| ***D06F 58/10*** | (2006.01) |

(52) U.S. Cl.

CPC ..... *D06F 58/24* (2013.01); *D06F 58/02* (2013.01); *D06F 58/10* (2013.01); *D06F 58/206* (2013.01); *D06F 58/20* (2013.01)

(58) Field of Classification Search

CPC ..... D06F 58/24; D06F 58/206
USPC ..... 34/292, 72, 73, 75, 76
See application file for complete search history.

(56) References Cited

U.S. PATENT DOCUMENTS

2013/0061821 A1 3/2013 Maeshima et al.
2015/0292140 A1* 10/2015 Coniguardi ..... D06F 58/02 34/108

FOREIGN PATENT DOCUMENTS

| | | |
|---|---|---|
| CN | 200964524 | 10/2007 |
| CN | 101319810 | 12/2008 |
| CN | 104110736 | 10/2014 |
| JP | 2004-135755 | 5/2004 |
| JP | 2007-000386 | 1/2007 |
| JP | 2007-330439 | 12/2007 |
| JP | 2013-057464 | 3/2013 |
| JP | 2014-018446 | 2/2014 |
| JP | 2014-150997 | 8/2014 |
| JP | 2015-107156 | 6/2015 |

(Continued)

OTHER PUBLICATIONS

Chinese Office Action (with English Translation) dated Mar. 14, 2018 issued in Chinese Application No. 201610632967.0.

(Continued)

*Primary Examiner* — John P McCormack
(74) *Attorney, Agent, or Firm* — KED & Associates, LLP

(57) ABSTRACT

A clothes treating apparatus includes: a heat pump cycle having an evaporator, a compressor, a condenser and an expansion valve, and configured to apply heat to air which circulates a clothes accommodation unit; a water cover configured to support the evaporator and the condenser on an upper surface thereof, and having therein a condensate water collection unit; and a condensate water separating unit protruding from the water cover to a space between the evaporator and the condenser, and configured to prevent scattering of condensate water to the condenser from the evaporator due to an air flow.

20 Claims, 3 Drawing Sheets

(56) References Cited

FOREIGN PATENT DOCUMENTS

| | | |
|---|---|---|
| KR | 10-0859932 | 9/2008 |
| KR | 2011-0080769 | 7/2011 |
| KR | 10-2014-0125531 | 10/2014 |
| WO | WO 2012/146533 | 11/2012 |
| WO | WO 2015/062148 | 5/2015 |

OTHER PUBLICATIONS

International Search Report and Written Opinion dated Nov. 10, 2016 issued in Application No. PCT/KR2016/007891.
European Search Report dated Jan. 3, 2017 issued in Application No. 16182558.3.

* cited by examiner

CLOTHES TREATING APPARATUS

CROSS-REFERENCE TO RELATED APPLICATION

This application claims priority under 35 U.S.C. § 119 to Korean Application No. 10-2015-0110228, filed on Aug. 4, 2015, whose entire disclosure is hereby incorporated by reference.

BACKGROUND

1. Field

This specification relates to a clothes treating apparatus capable of minimizing lowering of a drying function by preventing scattering of condensate water.

2. Background

Generally, a clothes treating apparatus serves to wash clothes or to dry clothes having undergone a washing process, or serves to perform both a washing function and a drying function. Recently, a clothes treating apparatus may be provided with a steam generator and having a refresh function (i.e., a wrinkle removing function, an odor removing function, an anti-static function, etc.) or a sterilization function.

For instance, a clothes treating apparatus may include a drum type drier for drying clothes having undergone a washing process, a cabinet type drier for drying clothes in a hung state of the clothes, a refresher for refreshing clothes by supplying hot blast to the clothes, etc. Among such clothes treating apparatuses, the refresher, the drier, etc. are provided with a heat source supply unit, and supply hot blast to clothes by heating air. The heat source supply unit includes a gas type heater for heating air by combusting gas, an electric type heater for heating air by electric resistance, a heat pump system for heating air using a heat pump cycle which circulates a refrigerant to a compressor, a condenser, an expansion valve and an evaporator, etc. Recently, such a heat pump system having excellent energy efficiency is being actively developed.

In a clothes drier having a heat pump system, air of high temperature and high humidity, discharged from a clothes accommodation unit such as a drum, passes through an evaporator and a condenser. Then, the clothes drier absorbs heat from the air of high temperature and high humidity, and supplies the heat to air to be introduced into the clothes accommodation unit, thereby enhancing energy efficiency.

A clothes drier or a drier having a washing function and a drying function, to which a heat pump cycle has been applied, may require a large air volume for enhanced performance of the heat pump cycle. For instance, as an rpm of a blower is increased, air discharged from a drum has an increased circulation speed, and a large air volume is provided to the heat pump cycle. An evaporator absorbs a large amount of heat from the air discharged from the drum with a large volume, and a condenser emits a large amount of heat to the air of a large volume to thus provide hot blast of a high air volume to the drum. This may enhance a drying function and shorten a drying time.

However, the conventional art may have the following problems. Firstly, in a case where the evaporator and the condenser which constitute the heat pump cycle are spaced from each other with a predetermined gap in a heat exchanger cover, and air discharged from the drum passes through the evaporator with a large air volume, condensate water generated from the evaporator may scatter. More specifically, the condensate water generated from the evaporator may scatter to a front end of the condenser from a rear end of the evaporator, due to a shear stress by an air flow. This may lower a temperature of the condenser, resulting in lowering of a drying function.

BRIEF DESCRIPTION OF THE DRAWINGS

The embodiments will be described in detail with reference to the following drawings in which like reference numerals refer to like elements wherein.

DETAILED DESCRIPTION

The present disclosure may be applied to a clothes drier having a drying function or a clothes drier having a washing function and a drying function, or a clothes treating apparatus provided with a stream supplier and having a refresh function and a sterilization function. The present disclosure may be also applicable to a drum type clothes drier and a cabinet type clothes drier.

Figure 1:
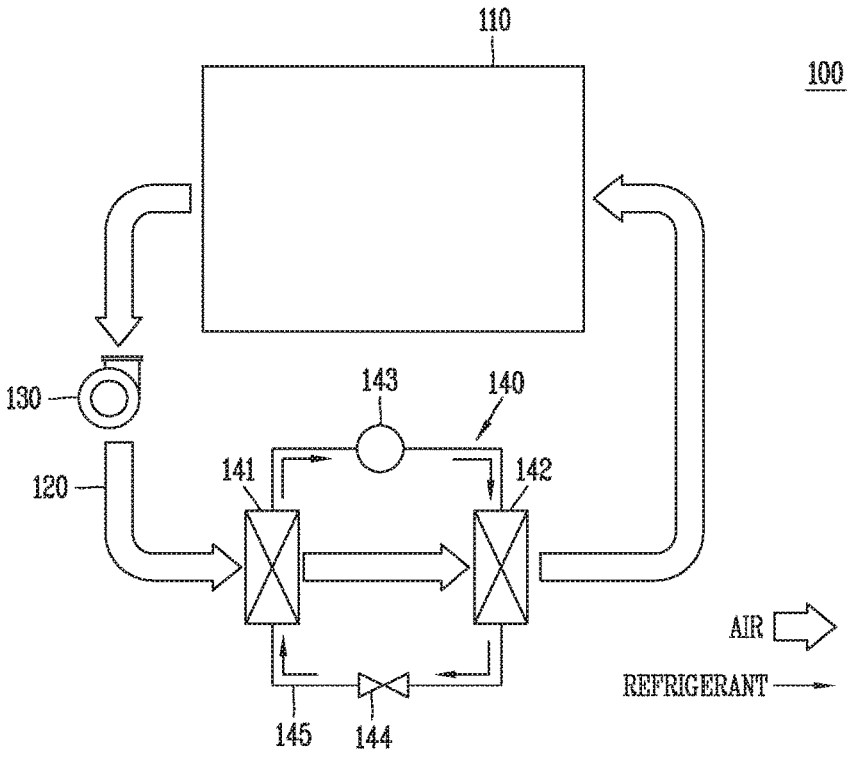
FIG. 1 is a view schematically illustrating a clothes treating apparatus having a heat pump cycle according to the present disclosure.

FIG. 1 is a view schematically illustrating a clothes treating apparatus 100 having a heat pump cycle 140 according to the present disclosure. The clothes treating apparatus 100 of FIG. 1 illustrates a drum type clothes drier, and may include a cabinet, a clothes accommodation unit (also referred to as a chamber), a driving unit, a blower 130 and a heat pump cycle 140.

The cabinet forms the appearance and a body of the product. The clothes accommodation unit may be provided in the cabinet to accommodate clothes therein. The clothes accommodation unit may include a tub provided in the cabinet, and a drum rotatably installed in the tub. Washing water may be stored in the tub. In case of the drum type clothes drier, a drum 110 is installed in the cabinet to thus accommodate clothes therein. The drum 110 may be rotated about a rotation shaft disposed at a rear side of the tub in a horizontal direction or in an inclined state with a predetermined angle.

The drum 110 has a hollow cylindrical shape, and provides an accommodation space where clothes to be dried is introduced. An opening is formed on a front surface of the drum 110, and an introduction opening is formed on a front surface of the cabinet. As the opening and the introduction opening are communicated with each other, clothes may be introduced into the drum 110. A door for opening and closing the introduction opening may be installed on a front surface of the cabinet with a hinge structure.

In order to effectively dry clothes to be dried, the drum 110 is rotatably installed. A lifter is provided in the drum 110, and clothes to be washed may be lifted to a position above the drum by the lifter and then may undergo a tumbling operation by dropping to a lower region of the drum by gravity.

The driving unit provides a rotational force using a motor, etc., and may be provided at a rear side of the tub. A rotation shaft of the motor is connected to a rear side of the drum 110, and a rotational force of the motor may be transmitted to the drum 110 to thus rotate the drum 110.

An air flow path may be connected to the drum 110, thereby forming a closed loop for air circulation. For instance, the air flow path may be formed as an air duct 120. An outlet of the drum 110 for air discharge may be formed at a lower region of a front surface of the drum 110, and an inlet of the drum 110 for air introduction may be formed on a rear surface of the drum 110. The air duct 120 may induce air circulation by communicating with the outlet and the inlet of the drum 110.

The blower 130 may be installed in the air duct 120 which extends from the outlet of the drum 110 to an evaporator 141 of the heat pump cycle 140, or may be installed in the air duct 120 which extends from a condenser 142 of the heat pump cycle 140 to the inlet of the drum 110. The blower 130 may be driven by an additional fan motor, and provides a driving force to air such that the air passes through the inside of the drum 110. And the blower 130 re-circulates the air discharged from the drum 110, into the drum 110. A lint filter is installed at the outlet of the drum 110, and may collect lint included in air as the air discharged from the drum 110 passes through the lint filter.

Clothes (laundry) has its moisture evaporated by hot blast supplied into the drum 110, and air passing through the drum 110 is discharged from the drum 110 within containing the moisture evaporated from the clothes. The air of high temperature and humidity, discharged from the drum 110, flows along the air flow path, and is heated by receiving heat from the heat pump cycle 140. Then, the air circulates the drum 110.

The heat pump cycle 140 includes an evaporator 141, a compressor 143, a condenser 142 and an expansion valve 144. The heat pump cycle 140 may use a refrigerant as an operation fluid. The refrigerant flows along a refrigerant pipe 145, and the refrigerant pipe 145 forms a closed loop for refrigerant circulation. As the evaporator 141, the compressor 143, the condenser 142 and the expansion valve 144 are connected to the refrigerant pipe 145, a refrigerant passes through the evaporator 141, the compressor 143, the condenser 142 and the expansion valve 144, sequentially.

The evaporator 141 is installed in the air duct so as to be communicated with the outlet of the drum 110, and collects heat of the air discharged from the drum 110 without discarding to the outside of the drier, by heat-exchanging the air discharged from the outlet of the drum 110 with the refrigerant. The condenser 142 is installed in the air duct so as to communicate with the inlet of the drum 110 and so as to be spaced from the evaporator in an air flow direction. And the condenser 142 emits heat of the refrigerant to the air to be introduced into the drum 110, by heat-exchanging the air having passed through the evaporator 141 with the refrigerant.

The evaporator 141 and the condenser 142 may be installed in the air duct 120. The evaporator 141 may be connected to the outlet of the drum 110, and the condenser 142 may be connected to the inlet of the drum 110.

Each of the evaporator 141 and the condenser 142 may be a fin & tube type heat exchanger. The fin & tube type heat exchanger has a structure where fins are attached to a hollow tube in the form of thin plates. As a refrigerant passes along the inside of the tube and air passes along an external surface of the tube, the refrigerant and the air are heat-exchanged with each other. The fins are used to increase a heat exchange area between the air and the refrigerant.

The air of high temperature and humidity, discharged from the drum 110, has a higher temperature than a refrigerant. Accordingly, the air is deprived of heat to the refrigerant of the evaporator 141 while passing through the evaporator 141, and is condensed to generate condensate water. As a result, the air of high temperature and humidity is dehumidified by the evaporator 141, and the condensate water may be discharged to the outside after being collected by a condensate water collection unit provided below the evaporator 141. The process of collecting and discharging the condensate water will be explained in more detail when a condensate water scattering preventing structure is explained later. A heat source of the air, absorbed by the evaporator 141 is moved to the condenser 142 by using a refrigerant as a medium, and the compressor 143 is positioned between the evaporator 141 and the condenser 142 such that the heat source is moved to the condenser 142 from the evaporator 141.

The compressor 143 is installed at the refrigerant pipe 145 which extends from the evaporator 141 to the condenser 142, and is configured to generate a refrigerant of high temperature and high pressure by compressing the refrigerant evaporated from the evaporator 141. And the compressor 143 controls the refrigerant of high temperature and high pressure to flow to the condenser 142, along the refrigerant pipe 145. The compressor 143 may be an inverter type compressor for varying a frequency in order to control a discharge amount of a refrigerant.

The expansion valve 144 is installed at the refrigerant pipe 145 which extends from the condenser 142 to the evaporator 141, and transfers a refrigerant condensed from the condenser 142 to the evaporator 141 after converting the refrigerant into a state of low temperature and low temperature by expansion.

A refrigerant flow path will be explained in more detail. Firstly, a refrigerant is introduced into the compressor 143 in a gaseous state, and is converted into a state of high temperature and high pressure by compression of the compressor 143. Then, the refrigerant of high temperature and high pressure is introduced into the condenser 142, and discharges heat to air at the condenser 142 to thus be converted into a liquid state from the gaseous state.

Then, the refrigerant of the liquid state is introduced into the expansion valve 144 to thus be converted into a state of low temperature and low pressure by a throttling operation of the expansion valve 144 (or a capillary tube). And the refrigerant of the liquid state is introduced into the evaporator 141 to thus absorb heat from air at the evaporator 141, thereby converting into a gaseous state.

The heat pump cycle 140 circulates a refrigerant to the compressor 143, the condenser 142, the expansion valve 144 and the evaporator 141, sequentially in a repeated manner. And the heat pump cycle 140 provides a heat source to air which circulates the drum 110. The present disclosure provides a condensate water separating unit (or deflector) 160 capable of preventing scattering of condensate water generated from the evaporator 141 to the condenser 142 due to a large air volume.

Figure 2:
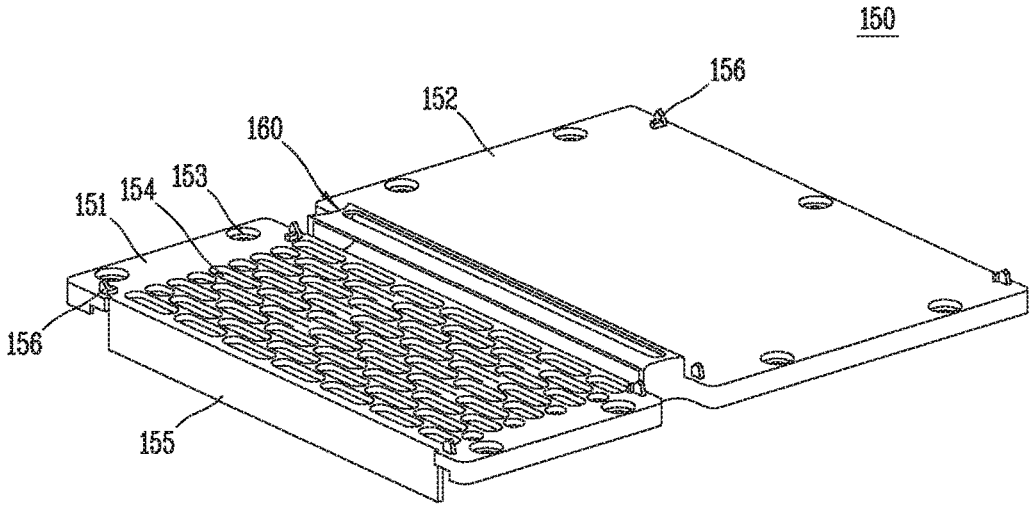
FIG. 2 is a perspective view of a water cover having a condensate water separating unit according to the present disclosure.
Figure 3:
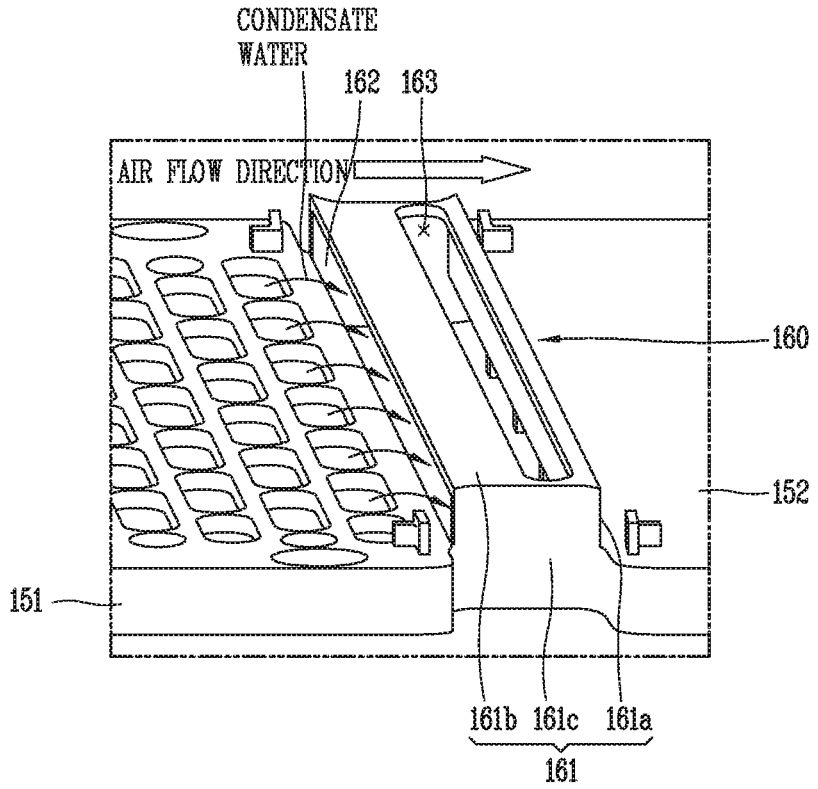
FIG. 3 is a partial perspective view of the condensate water separating unit of FIG. 2, which is seen from one side surface.
Figure 4:
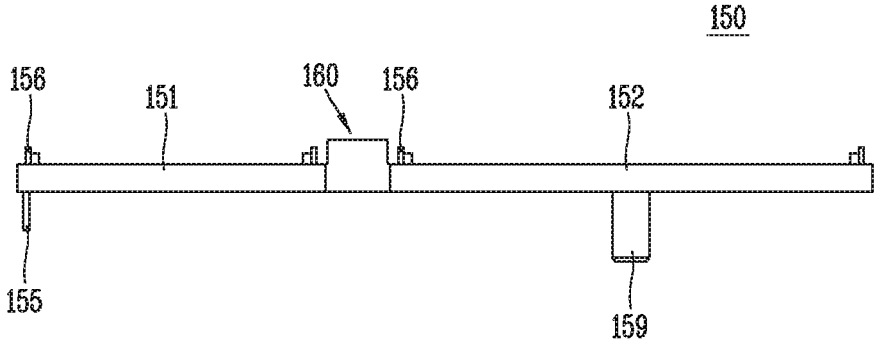
FIG. 4 is a side sectional view of FIG. 2.

FIG. 2 is a perspective view of a water cover (or support tray) 150 having the condensate water separating unit 160 according to the present disclosure. FIG. 3 is a partial perspective view of the condensate water collection unit (or space) of FIG. 2, which is seen from one side surface. And FIG. 4 is a side sectional view of FIG. 2. The water cover 150 is installed above a base. As coupling holes 153 are formed at an edge region of the water cover 150 at predetermined intervals, the water cover 150 and the base may be coupled to each other by coupling means such as bolts. The water cover 150 is installed below a heat exchanger cover, and the evaporator 141 and the condenser 142 spaced from each other in the heat exchanger cover are mounted to one side and another side of an upper surface of the water cover 150, respectively.

A first mounting unit 151 may be provided at one side of the water cover 150, thereby mounting the evaporator 141. A second mounting unit 152 may be provided at another side of the water cover 150, thereby mounting the condenser 142. A plurality of condensate water inflow holes 154 are penetratingly formed at an upper surface of the first mounting unit 151, such that condensate water generated from the evaporator 141 flows to a lower surface from an upper surface of the evaporator 141 to thus flow into the condensate water inflow holes 154.

A first condensate water collection unit 157 may be formed in the first mounting unit 151, thereby temporarily storing therein condensate water which flows to the first condensate water collection unit 157 through the condensate water inflow holes 154. The first condensate water collection unit 157 may occupy most of an entire area of the first mounting unit 151, in order to obtain a collection space of condensate water to the maximum.

A front plate 155 may downward extend from a front upper end of the first mounting unit 151, thereby providing a space of the first condensate water collection unit 157 with a predetermined depth. A supporting unit 159 may downward protrude from a bottom surface of the second mounting unit 152, thereby supporting the second mounting unit 152 and providing a space of the second condensate water collection unit (or space) 158 with a predetermined depth. The supporting unit 159 has a cavity therein, and the base and the second mounting unit 152 may be coupled to each other as a protrusion is inserted into the supporting unit 159.

The second condensate water collection unit 158 is formed in the second mounting unit 152, and the second condensate water collection unit 158 is communicated with the first condensate water collection unit 157. This may increase a storage space of condensate water collected in the first condensate water collection unit 157. The second condensate water collection unit 158 may occupy part of an entire area of the second mounting unit 152.

Coupling protrusions 156 may be formed at four corners of an upper surface of the first mounting unit 151, thereby coupling the evaporator 141 and the first mounting unit 151 to each other. The coupling protrusions 156 may be also formed at four corners of an upper surface of the second mounting unit 152, thereby coupling the condenser 142 and the second mounting unit 152 to each other.

The condensate water separating unit 160 may be formed to protrude between the first mounting unit 151 and the second mounting unit 152. The condensate water separating unit 160 may be formed between the first mounting unit 151 and the second mounting unit 152, in a direction to cross an air flow direction.

The condensate water separating unit 160 includes a separation body 161 which protrudes upward between the first mounting unit 151 and the second mounting unit 152. The separation body 161 may include an upper surface 161*b*, a rear surface 161*a*, and side surfaces 161*c*.

The rear surface 161*a* may extend from an upstream side of the condenser 142 in an upward protruding manner, based on a moving direction of a mixed fluid including air and condensate water. The upper surface 161*b* may forward-extend from an upper end of the rear surface 161*a*. The side surfaces 161*c* may connect two side surfaces of the upper surface 161*b* and two side surfaces of the rear surface 161*a*, respectively. For instance, the separation body 161 may have a height upward-protruded from a lower end of a rear surface of the evaporator 141 by a gap between the evaporator 141 and the condenser 142.

The separation body 161 includes therein an upper space for passing air therethrough, and a lower space for inducing condensate water to the first and second condensate water collection units 157, 158 of the first and second mounting units 151, 152. The upper space and the lower space of the separation body 161 are disposed between the first condensate water collection unit 157 and the second condensate water collection unit 158, and are communicated with the first condensate water collection unit 157 and the second condensate water collection unit 158. With such a configuration, condensate water collected in the separation body 161 may be collected to the first condensate water collection unit 157 and the second condensate water collection unit 158. The lower space of the separation body 161 may form a condensate water communication unit (or space) 164. The condensate water communication unit 164 may be formed between the first and second mounting units 151, 152.

An inlet 162 is formed at a front surface of the separation body 161. The front surface of the separation body 161 is disposed to face a rear lower end of the evaporator 141 based on an air flow direction, and indicates a surface into which the air and condensate water are introduced. For instance, the inlet 162 may be disposed near condensate water inflow holes 154 positioned at a rear end of the evaporator 141, among the condensate water inflow holes 154 of the first mounting unit 151. Accordingly, part of condensate water generated from the evaporator 141 may be introduced into the separation body 161 through the inlet 162. Part of the air passing through the evaporator 141 may be introduced into the separation body 161 through the inlet 162.

An air outlet 163 is formed at an upper surface of the separation body 161. The air outlet 163 provides a driving power to induce condensate water to a position below mounting surfaces of the evaporator 141 and the condenser 142. Here, the driving power indicates a force generated by an air flow, and means a shear force to induce condensate water to the condensate water collection unit lower than a bottom surface of the evaporator 141 or the condenser 142. The shear force is applied in the same direction as an air flow direction.

The air outlet 163 is preferably formed on the right side of the upper surface of the separation body 161, e.g., a downstream side based on an air flow direction. The reason is as follows. If a spacing distance between the air outlet 163 and the inlet 162 in an air flow direction is too short, an air suction amount through the inlet 162 is not sufficient. In this case, a mixed fluid including air and condensate water may move to a position above the inlet 162, and condensate water may not be induced to the inlet 162 of the separation body 161 because it is difficult to sufficiently obtain a shear force due to an air flow. Accordingly, it is preferable for the air outlet 163 to be positioned as far as possible from the inlet 162 of the separation body 161 within a spacing distance between the evaporator 141 and the condenser 142, for a shear force by an air flow.

If the air outlet 163 is not formed, air is filled in the upper space of the separation body 161 (i.e., a space above condensate water), and an inner pressure of the separation body 161 becomes higher than an outer pressure of the separation body 161. This may cause an eddy current to be generated from the inlet 162 of the separation body 161. Accordingly, air flows to an upper side outside the separation body 161 without being introduced into the separation body 161. As a result, condensate water is not induced into the separation body 161.

The inlet 162 and the outlet 163 of the separation body 161 may be formed in directions perpendicular to each other. With such a configuration, part of the air passing through the evaporator 141 may be introduced into the separation body 161 through the inlet 162, together with the condensate water condensed at the evaporator 141. And condensate water of high specific gravity and high density may immerse to the lower space of the separation body 161. On the other hand, condensate water of low specific gravity and low density may be introduced into the condenser 142 through the air outlet 163, after passing through the upper space of the separation body 161. Hereinafter, a condensate water scattering preventing structure of the present disclosure will be explained in more detail.

Figure 5:
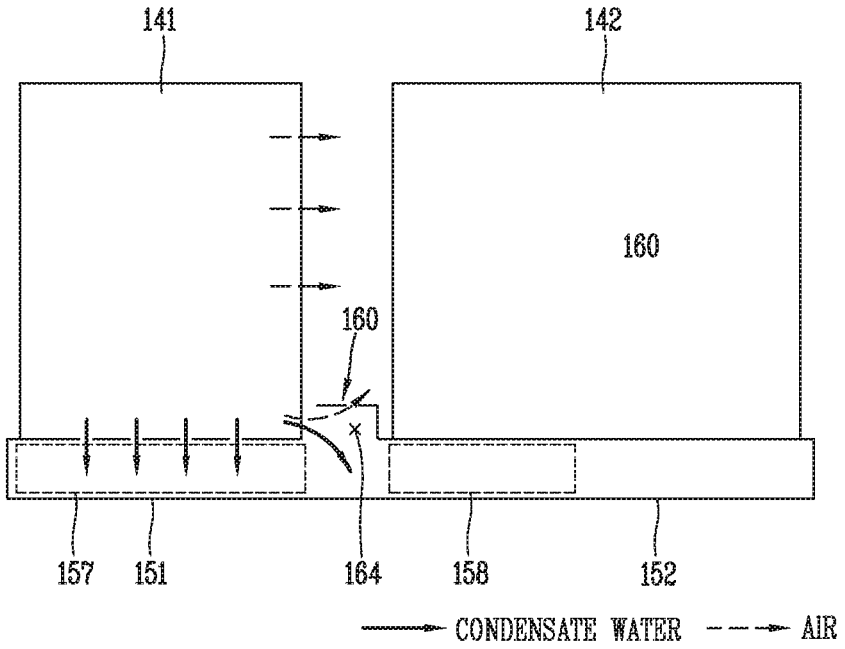
FIG. 5 is a schematic view illustrating a condensate water scattering preventing method according to the present disclosure.
Figure 6:
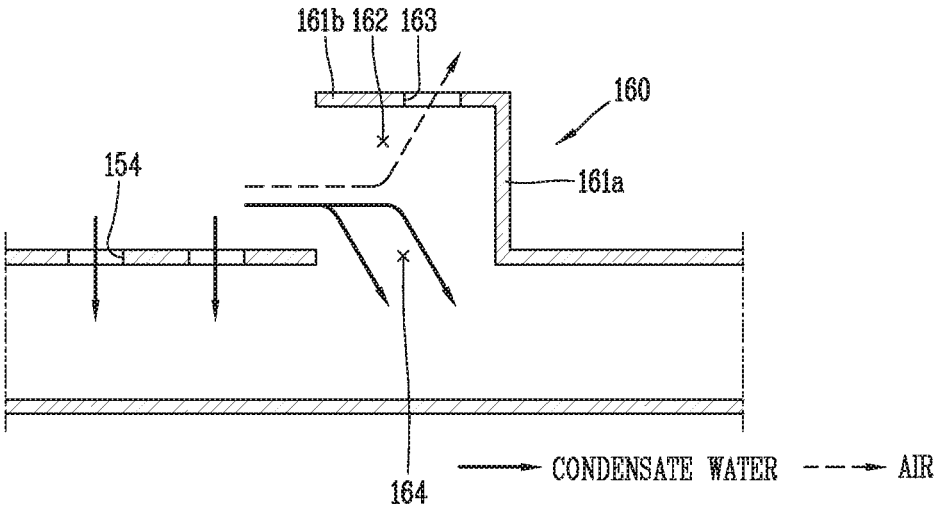
FIG. 6 is an enlarged sectional view illustrating a condensate water scattering preventing structure of FIG. 5.

FIG. 5 is a schematic view illustrating a condensate water scattering preventing method according to the present disclosure, and FIG. 6 is an enlarged sectional view illustrating a condensate water scattering preventing structure of FIG. 5. A process to generate condensate water from the evaporator 141 will be explained.

Firstly, a refrigerant which flows along the refrigerant pipe 145 disposed in the evaporator 141 is heat-exchanged with air passing through the evaporator 141. Since the refrigerant of the evaporator 141 has a lower temperature than the air, condensate water is generated on the surface of the refrigerant pipe 145 and the fins in the form of drops, by a temperature difference.

For instance, at a section between a front end and a rear end of the evaporator 141 based on an air flow direction, a surface tension between condensate water and the surface of the evaporator 141 is larger than a shear force due to an air flow (in a horizontal direction), and a gravitational force applied to the condensate water (in a vertical direction) is larger than the surface tension. As a result, condensate water flows down along the surface of the evaporator 141 to thus be collected in the first condensate water collection unit space 157 through the condensate water inflow holes 154.

However, if an air flow speed becomes higher by a large air volume, a different situation occurs from the rear end of the evaporator 141. That is, since condensate water flows down by the surface tension and the gravitational force, it is influenced by a shear force due to an air flow.

In the conventional art, condensate water scatters to a condenser together with air, without dropping to a bottom surface of an evaporator. However, in the present disclosure, condensate water is collected by the condensate water separating unit 160. An air flow path according to the present disclosure will be explained.

Firstly, part of air passing through the evaporator 141, i.e., air disposed in a lower region of the evaporator 141, includes part of condensate water generated from the evaporator 141. And the air having the condensate water is induced to the inlet 162 of the condensate water separating unit 160, by a shear force due to an air flow inside the separation body 161.

The air having the condensate water, induced to the inlet 162 of the condensate water separating unit 160, flows in the upper space of the separation body 161 in a horizontal direction. The air of a small weight flows to an upper region of the separation body 161 through the air outlet 163, thereby being introduced into the condenser 142. And the condensate water of a large weight is separated from the air which flows along the upper region of the separation body 161, due to a difference of specific gravities, thereby downward moving to the condensate water communication unit 164 disposed at the lower space of the separation body 161.

Then, the condensate water, which downward flows to the condensate water communication unit 164, is collected to the condensate water collection unit communicated with the condensate water communication unit 164. The collected condensate water may be discharged to the outside through a drain hose. One end of the drain hose may be connected to the condensate water collection unit or the condensate water communication unit 164, and another end thereof may be connected to the outside of the cabinet, thereby discharging condensate water to the outside.

In the present disclosure, condensate water condensed in the evaporator 141 does not scatter to the condenser 142, but is effectively collected to a lower part of the water cover 150. This may enhance performance of the clothes drier, and may shorten a drying time.

Based on the present disclosure, a clothes treating apparatus may include a heat pump system requiring a large air volume and may be capable of preventing scattering of condensate water generated from an evaporator to a condenser due to a shear stress by an air flow. A clothes treating apparatus may include a condensate water separating unit protruding between an evaporator and a condenser, and configured to collect condensate water which is to scatter to the condenser from the evaporator.

A clothes treating apparatus may include a heat pump cycle having an evaporator, a compressor, a condenser and an expansion valve, and configured to apply heat to air which circulates a clothes accommodation unit; a water cover having an upper surface where the evaporator and the condenser are mounted for heat-exchange with the air, and having therein a condensate water storage space; and a condensate water separating unit protruding from the water cover to a space between the evaporator and the condenser, and configured to prevent scattering of condensate water to the condenser from the evaporator due to an air flow.

In an embodiment of the present disclosure, the condensate water separating unit may include: a separation body connected to a condensate water collection unit; an inlet formed on a front surface of the separation body, and configured to introduce thereinto part of condensate water generated from the evaporator and air passing through the evaporator; and an air outlet configured to discharge the air introduced into the separation body through the inlet, to outside of the separation body.

With such a configuration, an air flow in a horizontal direction may be formed in the separation body through the inlet and the air outlet, and introduction of condensate water into the separation body may be induced by the air flow inside the separation body.

In an embodiment of the present disclosure, the air outlet may be formed on an upper surface of the separation body in at least one in number. With such a configuration, an air flow speed may be controlled according to a size of the air outlet and the number of the air outlets.

In an embodiment of the present disclosure, the air outlet may be formed on the upper surface of the separation body, in an inclined manner to one side toward the condenser. With such a configuration, a larger amount of air and condensate water may be introduced into the separation body as a shear stress by an air flow is increased.

In an embodiment of the present disclosure, the inlet may be formed to face a rear end of the evaporator. With such a configuration, a lower part of the rear end of the evaporator, to which condensate water scatters, may be covered by the inlet of the separation body.

In an embodiment of the present disclosure, the separation body may include a condensate water communication unit for connection with the condensate water collection unit, at a lower part thereof. With such a configuration, condensate water may be separated and collected.

In an embodiment of the present disclosure, the water cover may include a first mounting unit configured to mount the evaporator thereon; and a second mounting unit configured to mount the condenser thereon. And the condensate water separating unit may be disposed between the first and second mounting units.

In an embodiment of the present disclosure, the condensate water collection unit may be formed in each of the first and second mounting units. In an embodiment of the present disclosure, the condensate water separating unit may be long-formed in a direction crossing the first and second mounting units. In an embodiment of the present disclosure, condensate water collected in the condensate water collection unit may be discharged to the outside through a drain hose.

In an embodiment of the present disclosure, the inlet and the air outlet may be formed in directions perpendicular to each other. With such a configuration, an air flow direction inside the separation body may be the same as an air flow direction outside the separation body. And condensate water may be easily separated from air by gravity.

In the present disclosure, condensate water condensed in the evaporator may be effectively collected to a lower part of the water cover. Further, since scattering of condensate water to the condenser is prevented, a function of the clothes drier may be enhanced and a drying time may be shortened.

Further scope of applicability of the present application will become more apparent from the detailed description given hereinafter. However, it should be understood that the detailed description and specific examples, while indicating preferred embodiments of the disclosure, are given by way of illustration only, since various changes and modifications within the spirit and scope of the disclosure will become apparent to those skilled in the art from the detailed description.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A clothes treating apparatus, comprising:

a chamber;

a blower configured to blow air discharged from the chamber and returning the air to the chamber;

a support tray configured to support an evaporator and a condenser spaced apart from each other;

a deflector including a projection part vertically upward-protruding from the support tray, and the defector being disposed between the evaporator and the condenser, and being configured to receive a mixed fluid including the air passing through the evaporator and condensate water, the condensate water generated through a heat exchange between the air and a refrigerant of the evaporator, and the deflector being further configured to separate the condensate water from the from the mixed fluid to an inner region thereof, and then to discharge the air from the mixed fluid through an air outlet provided at an upper surface thereof.

2. A clothes treating apparatus, comprising:

a chamber configured to accommodate clothes therein;

a heat pump having an evaporator, a compressor, a condenser, and an expansion valve, the heat pump being configured to dry air circulating from the chamber through a first heat exchange at the evaporator and to apply heat to the dried air circulating back to the chamber through a second heat exchange at the condenser;

a support tray configured to support the evaporator and the condenser and having a condensate water collection space that collects, therein, condensate water generated from the evaporator during the first heat exchange; and a deflector including a projection part that is vertically upward-protruding from the support tray, the deflector being positioned in a space between the evaporator and the condenser, and being configured to receive a mixed fluid including the air flowing from the evaporator to the condenser and the condensate water and to separate the condensate water from the mixed fluid.

3. The clothes treating apparatus of claim 2, wherein the deflector includes a separation body in fluid communications with the condensate water collection space, the separation body having an inlet on a front surface thereof in an inflow direction of the mixed fluid and having an air outlet on an upper surface thereof, the air included in the mixed fluid being discharged out of the separation body after being separated from the condensate water.

4. The clothes treating apparatus of claim 3, wherein the upper surface of the separation body is disposed at a position higher than bottom surfaces of the evaporator and the condenser, such that the mixed fluid including the air blown from the evaporator and the condensate water is introduced into the separation body.

5. The clothes treating apparatus of claim 3, wherein two or more air outlets are formed on the upper surface of the separation body.

6. The clothes treating apparatus of claim 3, wherein the air outlet is positioned away from a front end of an upper surface of the separation body and towards the condenser.

7. The clothes treating apparatus of claim 3, wherein the inlet is formed to open toward a rear end of the evaporator.

8. The clothes treating apparatus of claim 3, wherein the separation body includes a condensate water communication space in fluid communications with the condensate water collection space.

9. The clothes treating apparatus of claim 2, wherein the support tray includes:

a first mounting section configured to mount the evaporator thereon; and a second mounting section configured to mount the condenser thereon, and wherein the deflector is disposed between the first and second mounting sections.

10. The clothes treating apparatus of claim 9, wherein the condensate water collection space includes:

a first condensate water collection space formed in the first mounting section; and a second condensate water collection space formed in the second mounting section.

11. The clothes treating apparatus of claim 9, wherein a long axis of the deflector is formed in a direction corresponding to an intersection of the first and second mounting sections.

12. The clothes treating apparatus of claim 3, wherein condensate water collected in the condensate water collection space is discharged outside of the condensate water collection space through a drain hose.

13. The clothes treating apparatus of claim 3, wherein the inlet and the air outlet are formed in directions perpendicular to each other.

14. A clothes treating apparatus, comprising:

a tub provided in a cabinet;

a drum rotatably installed in the tub;

an air duct connected to the tub and the drum, and forming a flow path for air circulation;

a blower configured to blow air discharged from the drum, through the air duct, and back to the drum;

an evaporator and a condenser spaced from each other in the air duct in an air flow direction;

a support tray configured to support each of the evaporator and the condenser, and having a plurality of condensate water inflow holes at an upper surface thereof where the evaporator is supported; and a deflector including a projection part vertically upward-protruding from the support tray, the deflector being provided between the evaporator and the condenser, and configured to receive a mixed fluid that includes the air blown from the evaporator to the condenser and condensate water and to separate the condensate water from the mixed fluid.

15. The clothes treating apparatus of claim 14, further comprising:

a condensate water collection cavity provided in the support tray, and configured to collect additional condensate water generated from the evaporator thereinto through the plurality of condensate water inflow holes.

16. The clothes treating apparatus of claim 15, wherein the condensate water separating cavity includes a separation body upward-protruding from the support tray, the separation body having an inlet on a front surface thereof in an inflow direction of the air and having an air outlet on an upper surface thereof and spaced from the inlet, the inlet introducing the mixed fluid including the air and the condensate water into the separation body, and the air outlet discharging the air separated from the condensate water.

17. The clothes treating apparatus of claim 16, wherein the condensate water collection cavity includes a first condensate water collection cavity formed in a first mounting section for mounting the evaporator, and a second condensate water collection cavity formed in a second mounting section for mounting the condenser, and wherein the separation body is provided therein with a condensate water communication space in fluid communications with the first and second condensate water collection cavities, such that the condensate water, after being separated from the air, is collected through the condensate water communication space and is carried to one of the first or second condensate water collection cavities.

18. A clothes treating apparatus, comprising:

a chamber configured to accommodate clothes therein, and having an accommodation space for drying the clothes by a hot blast;

an air duct forming a flow path for air circulation to the chamber;

a blower configured to blow air discharged from the chamber, through the air duct, and back to the chamber;

a heat pump having an evaporator and a condenser spaced from each other in the air duct, and configured to provide a heat source to air to be introduced into the chamber by heat-exchanging a refrigerant of the condenser with the air;

a support tray configured to support each of the evaporator and the condenser, and having a plurality of condensate water inflow holes at an upper surface thereof where the evaporator is supported; and a deflector including a projection part vertically upward-protruding from the support tray, the deflector being disposed between the evaporator and the condenser and configured to separate condensate water from a mixed fluid including the condensate water and the air passing through the evaporator, wherein the deflector prevents the condensate water from reaching the condenser, the condensate water being obtained through a heat exchange between the air passing through the evaporator and a refrigerant of the evaporator.

19. The clothes treating apparatus of claim 18, wherein the deflector includes:

a separation body having an inner space for temporarily storing the mixed fluid therein;

an inlet formed on a front surface of the separation body to receive the mixed fluid flowing from the evaporator; and an air outlet spaced from the inlet on an upper surface of the separation body in a moving direction of the mixed fluid, and configured to discharge air, separated from the mixed fluid inside the separation body, to the air duct.

20. The clothes treating apparatus of claim 19, wherein the separation body further includes:

a rear surface extending from an upstream side of the condenser in an upward protruding manner, based on a moving direction of the mixed fluid;

an upper surface forward-extending from an upper end of the rear surface; and side surfaces configured to connect two side surfaces of the upper surface and two side surfaces of the rear surface, respectively.

* * * * *